US010697176B2

(12) United States Patent
Kouijzer et al.

(10) Patent No.: US 10,697,176 B2
(45) Date of Patent: Jun. 30, 2020

(54) LUMINOUS FALSE-WALL DEVICE

(71) Applicant: NORMALU SAS, Kembs (FR)

(72) Inventors: Edwin Kouijzer, Valence D'Agen (FR); Jean-Marc Scherrer, Riedisheim (FR)

(73) Assignee: NORMALU, Kembs (FR)

( * ) Notice: Subject to any disclaimer, the term of this patent is extended or adjusted under 35 U.S.C. 154(b) by 0 days.

(21) Appl. No.: 16/315,402

(22) PCT Filed: Jun. 16, 2017

(86) PCT No.: PCT/EP2017/064742
§ 371 (c)(1),
(2) Date: Jan. 4, 2019

(87) PCT Pub. No.: WO2018/007125
PCT Pub. Date: Jan. 11, 2018

(65) Prior Publication Data

US 2019/0242123 A1 Aug. 8, 2019

(30) Foreign Application Priority Data

Jul. 6, 2016 (FR) ..... 16 56506

(51) Int. Cl.
*E04B 9/32* (2006.01)
*F21V 1/14* (2006.01)
(Continued)

(52) U.S. Cl.
CPC ..... *E04B 9/32* (2013.01); *E04B 9/30* (2013.01); *E04B 9/303* (2013.01); *F21V 1/14* (2013.01);
(Continued)

(58) Field of Classification Search
CPC ..... E04B 9/32; E04B 2009/0492; E04B 9/30; E04B 9/303; F21S 8/026; F21V 19/004;
(Continued)

(56) References Cited

U.S. PATENT DOCUMENTS 5,029,422 A 7/1991 Scherrer
8,054,407 B2 * 11/2011 Imojo ..... G02F 1/133605 349/65
(Continued)

FOREIGN PATENT DOCUMENTS

DE 10253343 A1 5/2004
EP 2494121 A1 9/2012
(Continued)

OTHER PUBLICATIONS

International Search Report dated Aug. 10, 2017 for PCT/EP2017/064742.

*Primary Examiner* — Peggy A Neils
(74) *Attorney, Agent, or Firm* — Oliff PLC

(57) ABSTRACT

A luminous false-wall device, comprising: a chassis constituted by at least one profile, the chassis comprising an upper part directed toward a panel to be covered, such as a wall or ceiling, and a lower part; a diffusing canvas fixed on the chassis and stretched on the lower part of the chassis; a light placed between the panel and the canvas configured to emit light in the direction of the canvas; wherein the chassis is provided with means of increasing the light intensity of the light.

13 Claims, 5 Drawing Sheets

(51) Int. Cl.

| | |
|---|---|
| ***E04B 9/30*** | (2006.01) |
| ***F21V 7/05*** | (2006.01) |
| ***F21V 7/24*** | (2018.01) |
| ***F21V 7/00*** | (2006.01) |
| ***F21V 19/00*** | (2006.01) |
| ***E04B 9/04*** | (2006.01) |
| ***F21Y 115/10*** | (2016.01) |
| ***F21S 8/02*** | (2006.01) |
| ***F21Y 103/00*** | (2016.01) |

(52) U.S. Cl.
CPC ..... *F21V 7/0041* (2013.01); *F21V 7/05* (2013.01); *F21V 7/24* (2018.02); *F21V 19/004* (2013.01); *E04B 2009/0492* (2013.01); *F21S 8/026* (2013.01); *F21V 7/005* (2013.01); *F21Y 2103/00* (2013.01); *F21Y 2115/10* (2016.08)

(58) Field of Classification Search
CPC ..... F21V 1/14; F21V 7/0041; F21V 7/005; F21V 7/05; F21V 1/02; F21V 1/16; F21V 7/0008; F21V 7/00; F21V 7/24; F21V 1/04; F21Y 2103/00; F21Y 2115/10
See application file for complete search history.

(56) References Cited

U.S. PATENT DOCUMENTS

| | | | | |
|---|---|---|---|---|
| 8,689,505 | B2 * | 4/2014 | Cousin | E04B 9/0428 52/222 |
| 8,955,998 | B2 * | 2/2015 | Wong | F21S 8/046 362/147 |
| 10,101,002 | B2 * | 10/2018 | Richter | F21V 1/16 |
| 2016/0312987 | A1 * | 10/2016 | Danesh | F21V 21/14 |
| 2019/0086057 | A1 * | 3/2019 | Kim | F21V 7/22 |

FOREIGN PATENT DOCUMENTS

| | | | |
|---|---|---|---|
| EP | 2722454 | A1 | 4/2014 |
| FR | 2630476 | A1 | 10/1989 |
| JP | 2009099465 | A | 5/2009 |

* cited by examiner

LUMINOUS FALSE-WALL DEVICE

BACKGROUND OF THE INVENTION

This invention concerns a luminous false-wall device to be attached to a panel such as a wall or a ceiling. The invention thus pertains to the technical field of stretched false ceilings and false walls, behind which a light source is placed.

False-wall devices comprising a stretched canvas fixed at the base of a chassis frame, generally rectangular, which is made of an association of profiles forming each one of its sides, are known in the prior art. To this end, the canvas comprises an attachment means fixed along its periphery. For example, as described in patent FR 2,630,476, the canvas may be provided with a peripheral hook-shaped outer edge. Another attachment means consists in clips inserted in the profiles, in which the canvas may be secured by pinching. The stretched canvas may be, for example, a textile material or a synthetic polymer material, such as polyvinyl chloride (PVC). The light source illuminates the canvas, which is translucent so as the light may propagate through the canvas and lighten the room in which the luminous false-wall device is installed.

In particular, in an application of the light box type, the assembly canvas/frame is placed in an external frame provided with lateral sides, a bottom side and lighting means. In the latter case, the chassis is fixed to the external frame and the light emitted by the lighting means passes through the translucent canvas.

Whether a false ceiling, a false wall or a light box, the light intensity on the outer side of the canvas is sometimes insufficient relative to the desired effect. On the one hand, the translucent canvas generally has a transmittance in the order of 50%, meaning that 50% of the light intensity is lost. On the other hand, the source of light may be far away from the canvas, which weakens the intensity of light striking it.

Solutions consist in bringing the light source closer to the canvas, to multiply the number of light sources or to increase their power. However, the implementation of these solutions has drawbacks. Moreover, a minimal safety distance is required between the light sources and the canvas to avoid degrading it. In spite of these solutions, there remains a problem of insufficient light intensity.

On the other hand, the profiles forming the chassis generally have a rectangular cross-section, with an upper side facing the wall or ceiling and a lower side facing the canvas. The canvas covers generally the entire lower side of the profile. Thus, when the stretched canvas is observed, the lower side of the profile is visible by transparency or by the shadow they cast on the canvas, creating an unsightly shaded area on all the perimeter of the chassis.

A known solution, described in patent EP 2,494,121, consists in using profiles with a triangular cross-section, with the tip directed toward the canvas and the two others edges are directed towards the wall or ceiling. In this way, only the tip directed toward the canvas can still be visible and the light may pass along the hypotenuse. This solution improves the lighting of the canvas's perimeter, but still does not allow a homogeneous lighting to be obtained on the whole of the canvas surface. Indeed, the profile itself, even if triangular in shape, still casts a shadow on the canvas, creating a shaded area along the perimeter of canvas, with a lighting intensity lower than the rest of the canvas.

SUMMARY OF THE INVENTION

The present invention aims at solving the various drawbacks mentioned above, by means of a device allowing to generally increase the intensity of light which passes through the canvas, and to homogenize the light intensity over the whole of the canvas surface area, while suppressing the conventional shaded area at the periphery. The device must simple to implement, and adaptable to a false wall, a false ceiling and a light box alike.

This aim is achieved by a luminous false-wall device comprising:

- a chassis constituted by at least one profile, said chassis comprising an upper part directed toward a panel to be covered, such as a wall or ceiling, and a lower part;
- a diffusion canvas fixed on the chassis and stretched on the lower part of the chassis;
- a lighting means placed between the panel and the canvas emitting light in the direction of the canvas.

This device is mainly characterised in that the chassis is provided with means of increasing the intensity of the lighting means.

The main idea of this invention consists in using the chassis itself to increase the light intensity outside the canvas, instead of playing directly on the lighting means parameters as was the case in the prior art.

More specifically, said means of increasing the light intensity consist in a reflective surface suitable for reflecting the incident rays from the lighting means toward the canvas. This invention is thus focused on optical principles, especially on the principle of total reflection, by using the reflecting surface of the chassis. According to the orientation of this surface, its reflective properties, its shape and the direction of the incident light rays from the lighting means, the intensity of the light emitted from the canvas may be increased.

According to various embodiments of this invention, which may be taken together or separately:

- each profile has an upper side oriented toward the panel, an external side oriented perpendicularly to the upper side, and an internal side facing the external side, said reflective surface being situated on the said internal side of the at least one profile: the cross-section of the profile may be rectangular or triangular in shape, for example.
- The reflective surface is preferably situated on the internal side of all the profiles: in this way, the light is reflected homogeneously by the whole chassis.
- The said reflective surface has a reflectance in the order of 100% and a transmittance in the order of 0%: this means that the reflection is total on this surface and that no light ray may pass through it. For example, this surface can be aluminium-coated.
- said reflective surface consists in a paint layer having reflective properties applied on said internal side.
- said reflective surface consists in a reflective plate fixed to the internal side: for example, this plate may be glued or attached by clips.
- said internal side of the profile comprises a recess suitable for receiving said reflective plate: if the width of the plate is inferior to that of the internal side of the profile, this recess allows the internal surface of the profile to remain smooth and completely flat.
- said reflective plate consists in a mirror.
- for each profile, the internal side directly binds the longitudinal edge of the upper side to a longitudinal edge of the external side: in this case, the profile has only three sides.
- the internal side consists in a flat surface: in this case, the profile's cross-section is of a triangular shape, the hypotenuse corresponding to the internal side. This flat surface may comprise a breakage.

the internal side consists in a concave surface, with the rounded part oriented toward the internal side of the device: in this case, the profile's cross-section is a quarter of an oval or a quarter of a circle, for example. The concave surface may have a more complex shape according to the desired reflection.

the chassis creates a shaded area on the canvas, at the periphery facing the chassis, the reflective surface being configured so as to redirect part of the rays coming from the lighting means to said shaded area in order to even out the level of luminosity on the entirety of the canvas surface.

said lighting means consist in at least one LED light source: other types of light sources may be used, such fluorescent or halogen lights, etc.

said lighting means consist in a plurality of light sources homogeneously distributed within the device: this distribution is calculated in such a way that the light is projected evenly on the totality of the canvas surface, so as there are no areas brighter than others.

said canvas consists in a translucent diffusing canvas, preferably of textile fabric or of PVC, with a light transmission of at least 50%.

a sheet is interposed between the canvas and the panel, and also fixed to the chassis: it may have a protective function against insects by preventing them to drop on the visible under-face of the canvas, or an acoustic function by improving the acoustic performance of the device, or a diffusion function to improve the distribution of light on the canvas, etc.

this translucent diffusing sheet, is preferably made of textile fabric or of PVC, with a light transmission of at least 50%.

the canvas covers all the inferior part of the chassis: in this way, the chassis structure itself is not visible, which improves the aesthetic appearance of the device.

This invention also concerns the use of the luminous false-wall device, such as described above, for making light boxes.

BRIEF DESCRIPTION OF THE DRAWINGS

The invention will be better understood and other purposes, details, characteristics, and advantages of the invention will appear more clearly on reading the following description given solely by way of an illustrating and non-limiting example and with reference to the accompanying schematic drawings.

In these drawings.

DETAILED DESCRIPTION

It is to be noted that in the figures, structural and/or functional elements which are common to various embodiments may have identical reference numbers. Thus, unless otherwise indicated, such elements have identical structural and functional properties.

Figure 1:
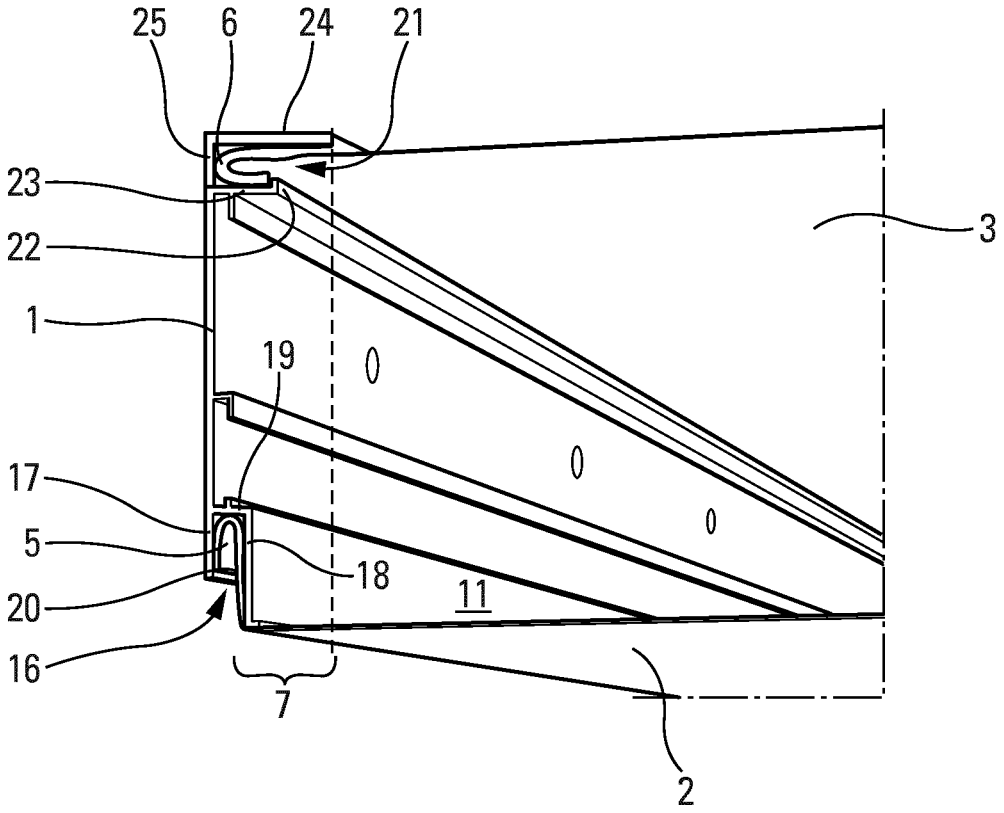
FIGS. 1 to 5 show perspective views of various examples of false-panel devices on which the present invention may be applied.

FIG. 1 shows one possible example of luminous false-wall device.

This device contains a chassis 1 constituted by a set of profiles having a complex structure. It is fixed to the vertical walls of a room by screws or any other attachment means.

For example, in order to mount a false-wall on a ceiling, the chassis comprises four profiles extending on the four walls of the room.

A canvas 2 is stretched between these four profiles, at the level of the lower part of the chassis, i.e. the part which is distal to the ceiling. This canvas 2 is provided along its peripheral edges with hook-shaped attachment means 5.

Each profile comprises, in its lower part, a groove 16 with a U-shaped cross-section, defined by two lateral sides 17, 18 and a bottom side 19. The ends of the lateral U-shaped sides, opposed to the bottom side 19, define an aperture for the passage of the hook 5 of the canvas 2 in the groove 16. In order to ensure the hooking of the hook 5 in the groove 16, the internal side of one of the lateral sides has a lip 20 for the longitudinal hooking. In the shown example, the lip 20 is provided on the inner side of the lateral side 17.

Several techniques exist for the hooking of the stretched canvas 2.

Instead of a hook, a beading may be sown on the peripheral edges of the canvas 2. This beading comprises a boss allowing it to be fixed to the lip of the groove.

It is also possible to insert a clip in the groove, the fixing of which still being ensured by the lip. The naked peripheral edges of the canvas 2 are then slid into the clip and retained by pinching.

Other techniques are also encompassed in the scope of the present invention.

In order that the room in which this luminous false-wall device is installed may be lighted, lighting means are provided on the ceiling, and the canvas 2 stretched under the lighting means diffuses the light.

Preferably, this diffusing canvas 2 is translucent, with a light transmission rate of at least 50%. This canvas may be made of textile fabric or PVC, or of any other suitable material.

Another canvas, which will be called "sheet" 3 to avoid any confusion, may optionally be interposed between the lighting means and the canvas 2. This sheet 3 is also diffusing and translucent, with a light transmission rate of at least 50%, in order to let through a maximum of light. This sheet 3 may serve various functions, namely:

a function of protection by preventing insects from dropping on the canvas 2, where they would be visible;

an acoustic function, with properties improving the acoustic performance of the room, for example a soundproofing function;

a lighting function, with a homogeneous distribution of the light diffusing through the sheet 3.

This sheet 3 is stretched and fixed to chassis 1 in the same manner as canvas 2, but in another groove 21 located in an upper part of chassis 1, closer to the ceiling. In the example shown, the sheet 3 is provided at its peripheral edges with hooks 6 suitable to be inserted into the groove 21.

This groove 21 has a U-shaped cross-section and is defined by two lateral sides 23, 24 and a bottom side 25.

The hook 6 is retained in the groove 21 by a lip 22 located on the internal side of the lateral wall 23.

In this example, the lateral wall 24 constitutes the upper wall of chassis 1. This wall 24 casts a shadow 7 on the canvas 2 at the vicinity of its peripheral edges. When the canvas 2 is observed from its internal side, a shaded area 7 is seen on the whole perimeter of the canvas 2.

Figure 2:
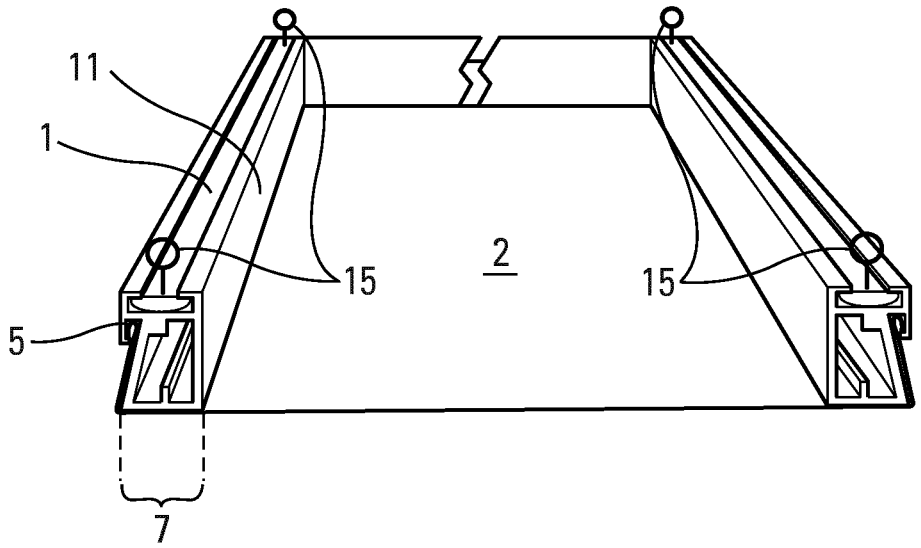

FIG. 2 shows a light box which may be suspended to a ceiling by hooks 15.

This box comprises a chassis 1 of rectangular shape, also formed by an assembly of four profiles. The profiles have a different shape than those of FIG. 1, but their function is identical. Indeed, their purpose is to stretch canvas 2. These profiles have a rectangular cross-section.

In this example, unlike in FIG. 1, the canvas 2 covers entirely the lower part of the chassis, then folds up along its external part so that its hook 5 may be fixed on the upper part.

In this case, the lower part of chassis 1, directly in contact with the canvas, casts a shadow 7 on all the perimeter of the canvas 2, as it prevents the light rays from lighting means 8 to illuminate the perimeter of the canvas 2 located just beneath the chassis.

Figure 3:
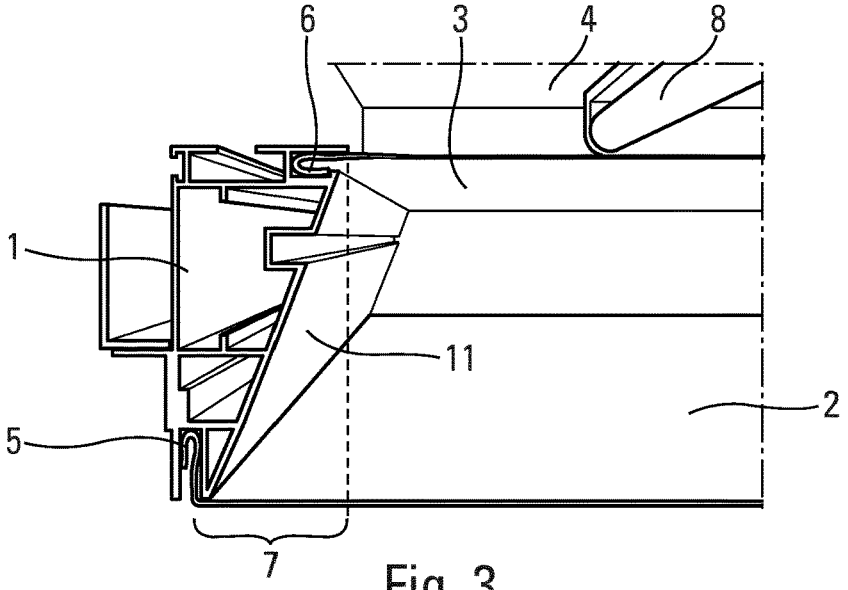
Figure 4:
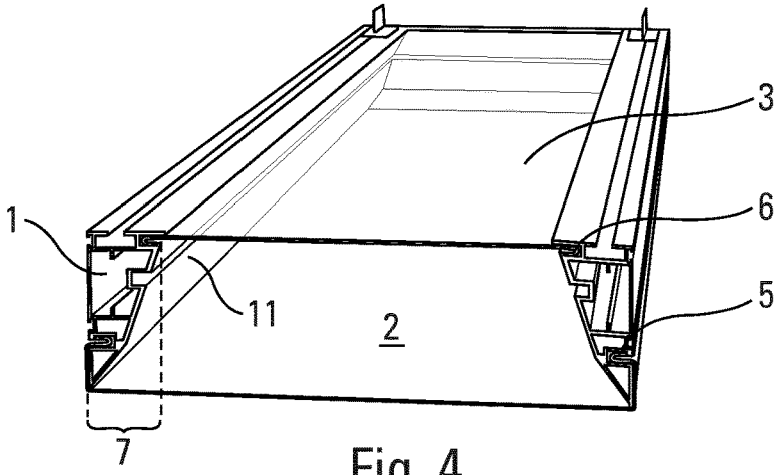
Figure 5:
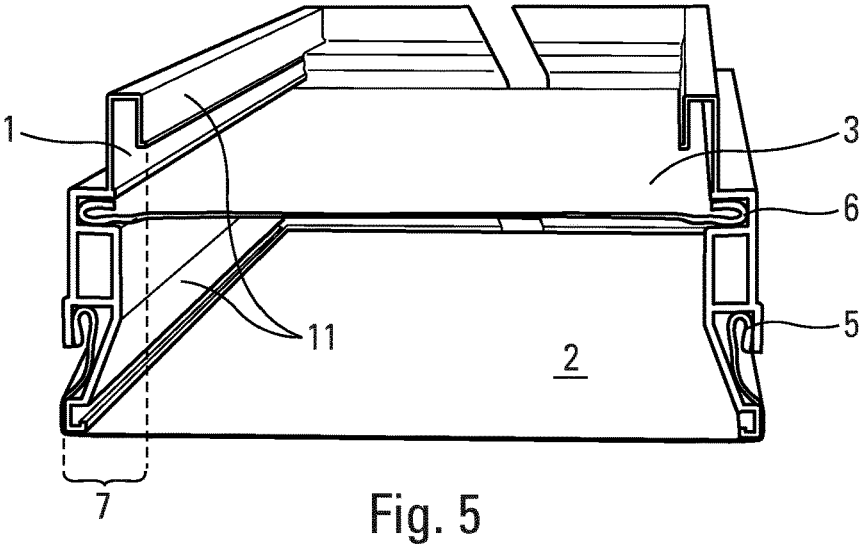

In order to avoid this, profiles with triangular cross-sections, as shown in FIGS. 3 to 5, are preferred. This type of cross-section allows light to pass on the perimeter of the canvas.

However, the upper part of the profiles still casts a shadow 7 on the perimeter of the canvas, albeit less obvious than in the case of FIG. 2, but still present.

FIG. 3 shows an example of lighting means 8, consisting of a neon tube fixed to the ceiling 4. However, any kind of lighting means 8 is encompassed in the scope of the present invention, namely ceiling or tile LEDs, less energy-consuming and heat-generating, which is advantageous from a safety viewpoint, in order to avoid fire hazards and degrading canvas 2.

On each of FIGS. 3 to 5, the canvas 2 is stretched on the lower part of chassis 1, and a sheet 3 is stretched on the upper part of chassis 1.

In all cases, these sets of chassis/canvas are adapted to cover a wall of a room, thus being placed vertically, or a ceiling, thus being placed horizontally. The chassis 1 may be fixed directly to ceiling by railings, or indirectly by being suspended, or fixed to the wall by screws as in FIG. 3. The chassis/canvas assembly may also be no more than a light box covering only part of a ceiling or a wall, for decorative purposes. All possible configurations are encompassed in the scope of the present invention.

Figure 6:
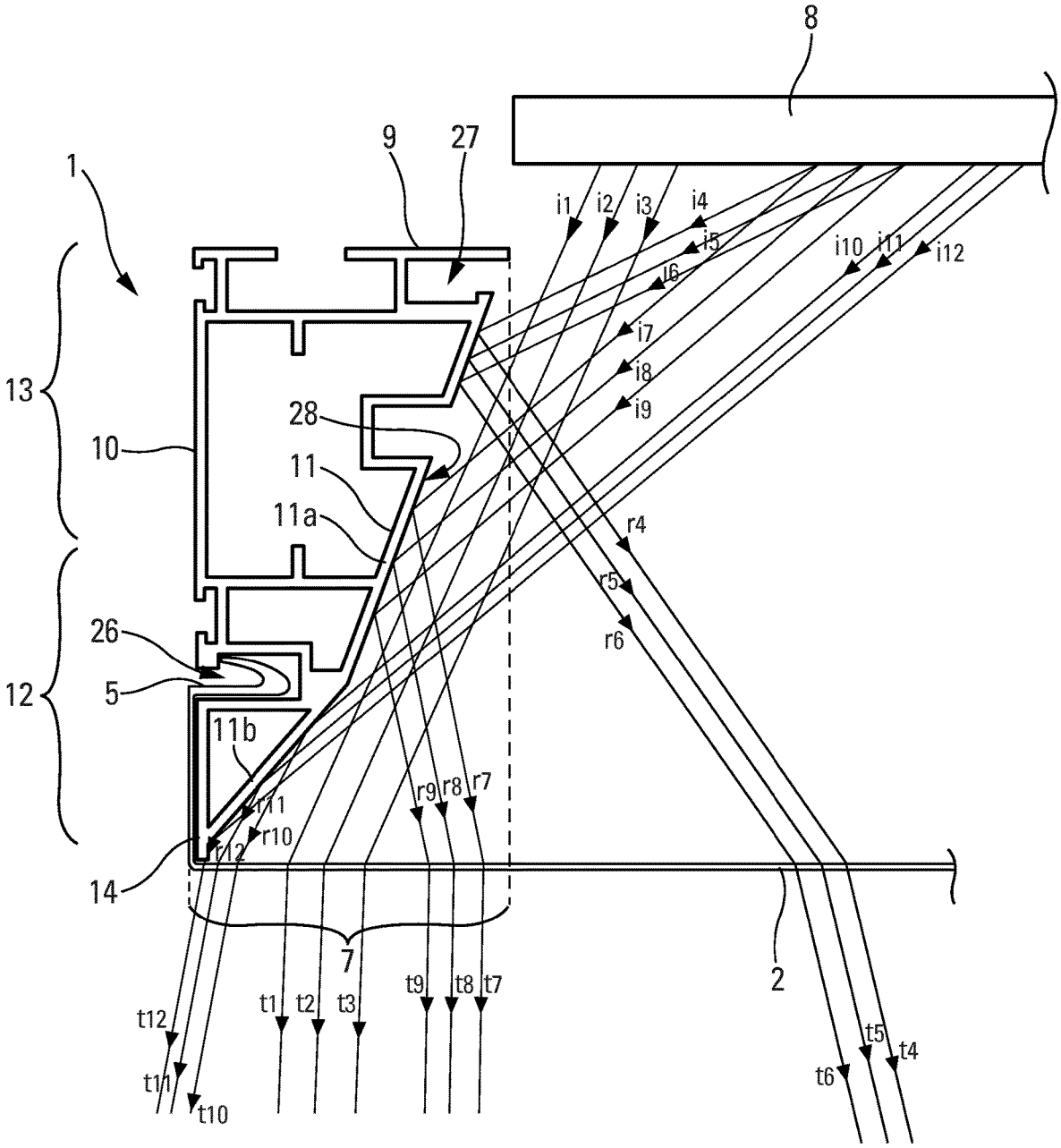
FIG. 6 is an enlarged view of the light path through part of the false-wall device of this invention.

With reference to FIG. 6, the device according to this invention is shown in detail, with a profile having a triangle shaped cross-section.

More specifically, the profile has an upper side 9 directed toward the panel to cover, an external side 10 and an internal side 11 facing the external side 10, the internal side 11 and external side 10 being joined at the tip 14 of the triangle.

The canvas 2 covers this tip 14 and is fixed in the profile at the level of a groove 26, equivalent to the groove 16 in FIG. 1, made on the external side 10.

A groove 27, made on the internal side of the upper part of the profile, is provided to optionally accommodate a protection sheet 3.

The upper side 9 of the profile casts a shadow 7 on the periphery of canvas 2, as explained previously.

The internal side 11 is coated with a reflective layer. In particular, this reflective surface 28 reflects the light emitted by the lighting means 8. In this example, the lighting means is a LED tile, thus a multiple source device.

The reflective layer may be obtained by applying a coat of specific paint on the internal side 11, or by fixing a reflective plate on the internal side 11, or by fixing a mirror on the internal side 11, or by any other means allowing a reflective surface 28 with total reflection to be obtained, i.e. with a reflectance in the order of 100% and a transmittance in the order of 0%.

FIG. 6 shows different paths of the light emitted by a ceiling light source. In this example, the internal side 11 has a breakage separating a first section 11*a* from a second section 11*b*, both sections 11*a* and 11*b* having a different reflection angle. However, as will be explained in the description below, it is merely one example among others, and the internal side 11 may well be entirely flat.

Some incident rays i1, i2, i3 directly impact the canvas 2, without touching the profile. Then, they are slightly refracted by the canvas 2, forming refracted rays t1, t2, t3. These rays are present in the shaded area 7, whether the profile has a reflective surface 28 or not.

Other incident rays i7, i8, i9 impact the reflective surface 28, and are reflected toward the canvas 2, and more particularly in the direction of the shaded area 7. These reflected rays r7, r8, r9 are then slightly refracted by the canvas 2, and form the rays t7, t8, t9 illuminating the outside of the canvas. In the prior art, these incident rays i7, i8, i9 were stopped or absorbed by the profile and consequently not reflected. The existence of the reflective surface 28 thus allows the quantity of light rays striking the canvas 2 to be increased.

The incident rays i10, i11, i12 also strike the reflective surface 28 at the level of a section 11*b* of the internal side 11 having a different angle from the section 11*a* of the internal side 11 where the rays i4 to i9 strike. This section 11*b* thus reflects the light under a different angle, so forming the reflected rays r10, r11, r12 hitting the canvas 2, then forming the refracted rays t10, t11, t12 leaving the canvas 2. These rays also strike the shaded area 7, whereas they were stopped by the profile in the prior art.

In this example, rays t1, t2, t3, t7, t8, t9, t10, t11, t12 all strike the periphery of the canvas, whereas in the prior art only rays t1, t2, t3 succeeded to do so. This considerable increase of the number of rays reaching the periphery of canvas 2 allows the shaded area 7 to be strongly abated, or even suppressed.

This reflective surface 28 thus allows the distribution of light on the canvas 2 to be homogenized, in order to improve the aesthetic qualities of the device.

On the other hand, this reflective surface 28 also allows the general level of lighting on the canvas 2 to be increased.

Indeed, for example, the incident rays i4, i5, i6 are reflected by the reflective surface 28, forming reflected rays r4, r5, r6 directed on the canvas 2 outside the shaded area, i.e. in the central area of the canvas 2. These rays are then slightly refracted and form the rays t4, t5, t6 on the outside of the canvas 2. These incident rays i4, i5, i6 were stopped by the profile of the prior art, and are now projected on the canvas 2, thus generating a global increase of the lighting power at the output of canvas 2, even outside the shaded area 7.

Figure 7:
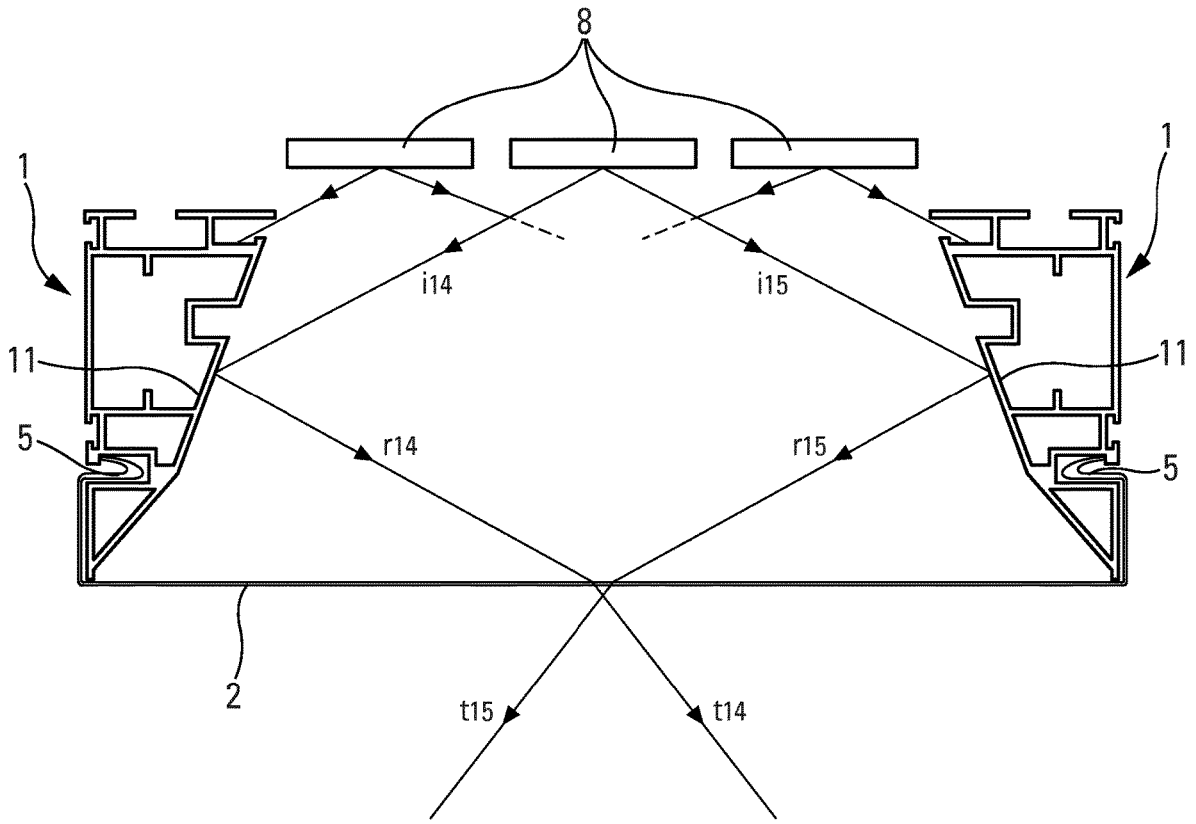
FIG. 7 is a schematic view of a false-wall device of this invention.

This is better represented in FIG. 7, where the incident rays i14, i15 form the reflected rays r14, r15 striking a more central area of canvas 2, before being slightly refracted into rays t14, t15 at the output of canvas 2.

However, it is to be noted that the paths of the light rays are purely indicative and that other angles of incidence, reflection and refraction may be obtained by exploiting numerous parameters, such as the orientation of the light sources, the slope of the internal side 11, the reflection properties of the reflective surface 28, the refractive properties of the canvas 2, etc. The addition of a sheet 3 also changes the path of the incident rays.

In particular, the internal side 11 may have various shapes according to the desired result at the output of the canvas.

Figure 8:
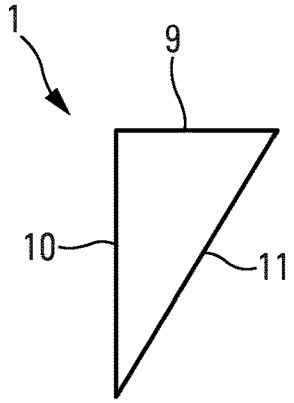
FIGS. 8 to 11 represent various shapes of the profiles' cross-section for the false-wall device of this invention.

In FIG. 8, the internal side 11 of the profile is entirely flat.

Figure 9:
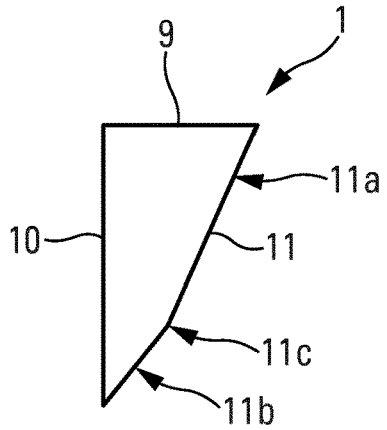

In FIG. 9, the internal side 11 of the profile has a breakage 11*c* separating two flat sections 11*a* and 11*b*, illustrating the form shown in FIGS. 6 and 7.

Figure 10:
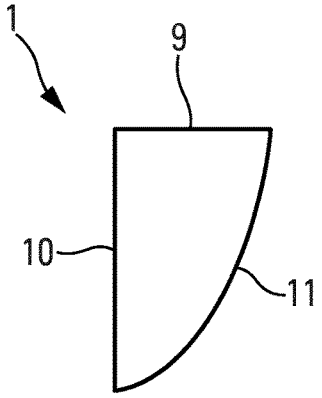

In FIG. 10, the internal side 11 has a concave shape, with the rounded part oriented toward the interior of the device. The rounded part corresponds to a quarter of an oval.

Figure 11:
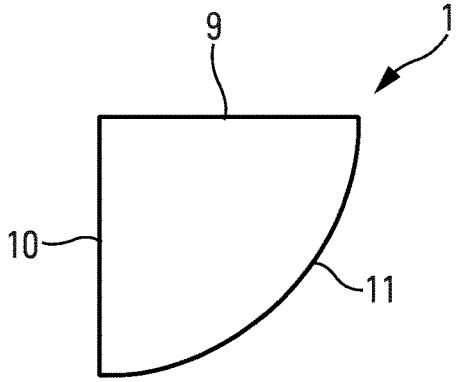

In FIG. 11, the internal side 11 has a concave shape, with the rounded part oriented toward the interior of the device. The rounded part corresponds to a quarter of a circle.

Of course, other shapes may be envisioned, in order to better reflect the rays coming from the light sources 8.

Figure 12:
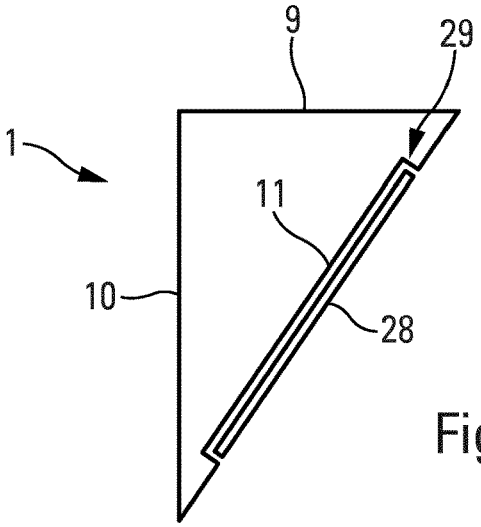
FIG. 12 shows the integration of a reflective plate on the internal side of a profile.

Referring to FIG. 12, in the case of a reflective plate 28 the width if which is inferior to that of the internal side 11 of the profile, a recess 29 may be provided on the internal side 11 in order to accommodate the plate 28. The width of the recess is substantially equal to that of the plate 28, so as the external appearance of the profile, on the internal side, is completely smooth, without any asperity. This allows the light to be reflected properly.

The reflective surface 28 may be implemented on all the examples shown in FIGS. 1 to 5. In particular, the internal side 11 of chassis 1 (especially the profiles) may be provided with a reflective surface 28.

The intensity of the light coming out of the canvas 2 will be generally increased.

In addition, the light will be distributed homogeneously on the total surface area of canvas 2, even in the shaded area 7, except for the device of FIG. 2 where the shaded area 7 will remain across the width of the lower part of chassis 1 in contact with the canvas 2.

In the examples described, the chassis 1 forms a rectangle with four profiles so as to adopt the conventional rectangular shape of a ceiling, a wall or a box. However, it is possible to envision a chassis having a circular or oval shape, with one or a plurality of appropriately shaped profiles. This invention encompasses all these embodiments.

Concerning the above description, the optimal dimensional relations of the parts of the invention, including any variations in size, materials, shapes, function and modes of working, assembly and use, are considered as apparent and obvious to the person skilled in the art, and all relations equivalent to those shown in the drawings and those detailed in the description are intended to be included in the present invention.

The invention claimed is:

1. A luminous false-wall device comprising:

a chassis constituted by at least one profile, the chassis comprising an upper part directed toward a panel to be covered and a lower part;

a diffusing canvas fixed on the chassis and stretched on the lower part of the chassis; and a light source placed between the panel and the canvas configured to emit light in the direction of the canvas, wherein the chassis is provided with means of increasing the light intensity of the light, the means of increasing the light intensity comprising a reflective surface suitable for reflecting the incident rays from the light source toward the canvas, and the chassis creates a shaded area on the canvas at a periphery facing the chassis, the reflective surface being configured to redirect part of the rays coming from the light source to the shaded area in order to even out a level of luminosity on an entirety of a surface of the canvas.

2. The luminous false-wall device according to claim 1, wherein each profile has an upper side facing the panel, an external side perpendicular to the upper side, and an internal side facing the external side, the reflective surface being located on the internal side of at least one profile.

3. The luminous false-wall device according to claim 1, wherein the reflective surface has a reflectance in the order of 100% and a transmittance in the order of 0%.

4. The luminous false-wall device according to claim 1, wherein the reflective surface comprises a layer of paint having reflective properties applied on the internal side.

5. The luminous false-wall device according to claim 1, wherein the reflective surface comprises a reflective plate fixed to the internal side.

6. The luminous false-wall device according to claim 5, wherein the reflective plate comprises a mirror.

7. The luminous false-wall device according to claim 2, wherein, for each profile, the internal side directly joins a longitudinal edge of the upper side to a longitudinal edge of the external side.

8. The luminous false-wall device according to claim 7, wherein the internal side comprises a flat surface.

9. The luminous false-wall device according to claim 7, wherein the internal side comprises a concave surface, with the rounded portion oriented toward the interior of the device.

10. The luminous false-wall device according to claim 1, wherein the light source comprises at least one light source of the LED type.

11. The luminous false-wall device according to claim 1, wherein the light source comprises a plurality of light sources distributed homogeneously across the device.

12. The luminous false-wall device according to claim 1, wherein the canvas comprises a translucent diffusing canvas, comprising at least one of a textile fabric and a PVC, with a light transmission rate of at least 50%.

13. A method for manufacturing light boxes comprising utilizing the luminous false-wall device according to claim 1.

* * * * *